US008070429B2

(12) United States Patent
Burdgick et al.

(10) Patent No.: US 8,070,429 B2
(45) Date of Patent: Dec. 6, 2011

(54) TURBINE SINGLET NOZZLE ASSEMBLY WITH MECHANICAL AND WELD FABRICATION

(75) Inventors: Steven Sebastian Burdgick, Schenectady, NY (US); Andrew Paul Greif, Geneva, IL (US)

(73) Assignee: General Electric Company, Schenectady, NY (US)

( * ) Notice: Subject to any disclaimer, the term of this patent is extended or adjusted under 35 U.S.C. 154(b) by 453 days.

(21) Appl. No.: 12/402,081

(22) Filed: Mar. 11, 2009

(65) Prior Publication Data

US 2010/0232934 A1 Sep. 16, 2010

(51) Int. Cl.
*F01D 9/04* (2006.01)

(52) U.S. Cl. ..... 415/191; 415/209.4

(58) Field of Classification Search ..... 415/189–191, 415/208.2, 209.2–209.4, 210.1
See application file for complete search history.

(56) References Cited

U.S. PATENT DOCUMENTS

| | | | | |
|---|---|---|---|---|
| 6,354,797 | B1 * | 3/2002 | Heyward et al. | 415/191 |
| 6,932,568 | B2 * | 8/2005 | Powis et al. | 415/189 |
| 7,427,187 | B2 | 9/2008 | Burdgick et al. | |
| 7,470,109 | B2 * | 12/2008 | Tomko et al. | 415/209.4 |
| 2007/0086892 | A1 * | 4/2007 | Tomko et al. | 415/209.2 |

* cited by examiner

*Primary Examiner* — Gary F. Paumen
(74) *Attorney, Agent, or Firm* — Hoffman Warnick LLC

(57) ABSTRACT

Embodiments of this invention include a nozzle assembly for a turbine, the nozzle assembly including an airfoil, inner and outer sidewalls, and inner and outer rings. Each of these sidewalls and rings are coupled together at an interface through a combination of a mechanical interconnection on one end and a welded connection on the other end. The mechanical interconnection includes either the sidewalls or the rings having a protruding hook and the other having a corresponding hook recess. The interconnection can also include axial and radial mechanical stops. The configuration may further include one or more surfaces at an interface between a ring and a sidewall angled away from the interface to form a narrow groove. The configuration further may include a ring with a consumable root portion.

20 Claims, 13 Drawing Sheets

TURBINE SINGLET NOZZLE ASSEMBLY WITH MECHANICAL AND WELD FABRICATION

CROSS REFERENCE TO RELATED APPLICATIONS

This patent application relates to commonly-assigned U.S. patent application Ser. No. 12/402,066 entitled "TURBINE SINGLET NOZZLE ASSEMBLY WITH RADIAL STOP AND NARROW GROOVE", filed concurrently with this application.

FIELD OF THE INVENTION

The invention relates generally to turbine technology. More particularly, the invention relates to a turbine singlet nozzle assembly design with both mechanical and weld fabrication on the same side of the nozzle.

BACKGROUND OF THE INVENTION

Turbines, including gas or steam turbines, include nozzle assemblies that direct a flow of steam or gas into rotating blades, or airfoils, that are coupled to a rotating shaft so as to cause the rotating shaft to turn. One configuration for the nozzle assemblies includes a singlet design, including a blade, or airfoil, between inner and outer sidewalls, with the sidewalls coupled to an inner and outer ring, respectively, and with mechanical axial and radial stops at the interfaces between the sidewalls and rings.

Fabricating the singlet nozzle assemblies requires welding the various parts of nozzle assembly together on both sides of the nozzle, i.e., welding the inner end of the nozzle to an inner ring, and welding the outer end of the nozzle to an outer ring. Typically, both an entrance and exit side of the interface between a nozzles and a ring are welded together. However, welding can introduce large amounts of heat that can distort the parts of the singlet nozzle being welded. One concern of the designs that use weld on entrance and exit sides is the cost of having to flip the part to do the opposite side weld. Another issue is the added distortion of having to weld on both the entrance and exit side of the nozzle assembly. In other words, lifting can occur when welding the first side of the nozzle to the ring because the opposite side will lift off the ring due to weld shrinkage on the welded side.

Another issue with welding both the entrance and exit sides of the interface between an airfoil and a ring is that after welding, a significant amount of material would need to be removed from the nozzle assembly to create an inner and outer sidewall leading up to the airfoil.

BRIEF DESCRIPTION OF THE INVENTION

Embodiments of this invention include a nozzle assembly for a turbine, the nozzle assembly including an airfoil, inner and outer sidewalls, and inner and outer rings. Each of these sidewalls and rings are coupled together at an interface through a combination of a mechanical interconnection and a weld. The mechanical interconnection includes either the sidewalls or the rings having a protruding hook and the other having a corresponding hook recess. The interconnection can also include axial and radial mechanical stops. The configuration may further include one or more surfaces at an interface between a ring and a sidewall angled away from the interface to form a narrow groove. The configuration further may include a ring with a consumable root portion.

A first aspect of the disclosure provides a nozzle assembly for a turbine, the nozzle assembly comprising: an airfoil having an outer sidewall; an outer ring mechanically coupled to the outer sidewall at an interface; a mechanical axial stop at the interface of the outer sidewall and the outer ring, the mechanical axial stop configured to maintain the airfoil in a correct axial position; and a mechanical radial stop at the interface of the outer sidewall and the outer ring, the mechanical radial stop configured to maintain the airfoil in a correct radial position, one of the outer sidewall or the outer ring including a protruding hook that extends into a corresponding hook recess in the other of the outer ring or the outer sidewall, wherein a first side of the interface is mechanically coupled together via the protruding hook and the corresponding hook recess, and a second side of the interface includes a welded connection.

A second aspect of the disclosure provides a nozzle assembly for a turbine, the nozzle assembly comprising: an airfoil having an inner sidewall; an inner ring mechanically coupled to the inner sidewall at an interface; a mechanical axial stop at the interface of the inner sidewall and the inner ring, the mechanical axial stop configured to maintain the airfoil in a correct axial position; and a mechanical radial stop at the interface of the inner sidewall and the inner ring, the mechanical radial stop configured to maintain the airfoil in a correct radial position, one of the inner sidewall or the inner ring including a protruding hook that extends into a corresponding hook recess in the other of the inner ring or the inner sidewall; wherein a first side of the interface is mechanically coupled together via the protruding hook and the corresponding hook recess, and a second side of the interface includes a welded connection.

DETAILED DESCRIPTION OF THE INVENTION

Figure 2:
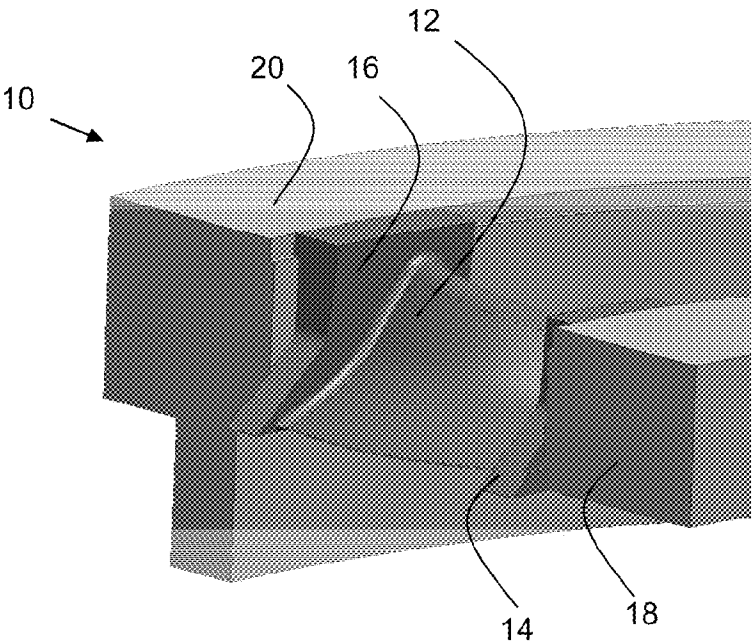
FIG. 2 shows a three-dimensional schematic of a nozzle assembly for a turbine.
Figure 1:
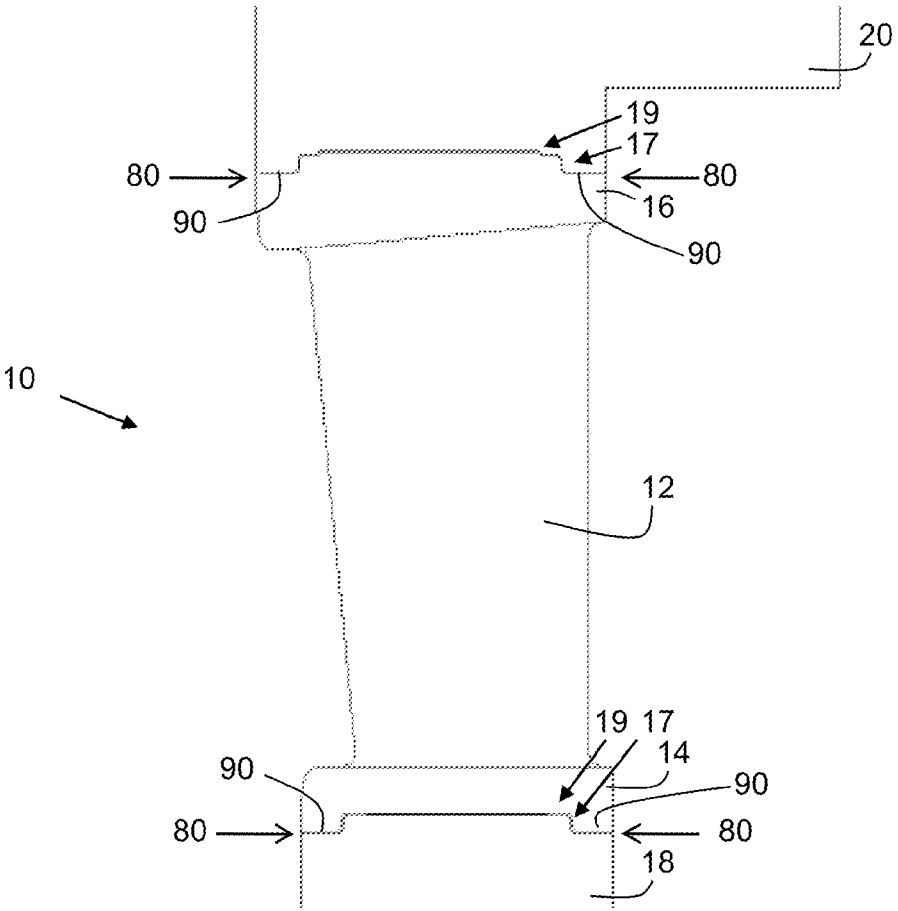
FIG. 1 shows a schematic of a nozzle assembly for a turbine.

Referring to the drawings, FIG. 1 shows a nozzle assembly 10 for a gas or steam turbine (not shown) as disclosed in related application Ser. No. 12/402,066 entitled "TURBINE SINGLET NOZZLE ASSEMBLY WITH RADIAL STOP AND NARROW GROOVE." FIG. 2 shows a three-dimensional schematic of nozzle assembly 10. Nozzle assembly 10 includes at least one airfoil 12 having an inner sidewall 14 and an outer sidewall 16. Nozzle assembly 10 further includes an inner ring 18 and an outer ring 20. Inner and outer, as used herein, refer to a radial position relative to a rotor (not shown) to which an inner end of airfoil 12 is coupled via inner ring 18. Inner ring 18 and inner sidewall 14 (and similarly outer ring 20 and outer sidewall 16) are coupled together at an interface 80, which is understood to refer to the entire area where the rings and sidewall are adjacent and coupled. Inner ring 18 and inner sidewall 14 (and similarly outer ring 20 and outer sidewall 16) are welded together at several points at interface 80. The multiple welded areas of interfaces 80, on both an entrance (front) side of airfoil 12 and an exit (back) side of airfoil 12, that are welded together are shown generally as areas 90 in FIG. 1. Interfaces 80 between rings 18, 20 and sidewalls 14, 16 may each include a mechanical radial stop 19 which maintains airfoil 12 in the correct radial position during welding and prevents weld shrinkage. Interfaces 80 each may further include a mechanical axial stop 17 which maintains airfoil 12 in the correct axial position and controls the weld length depth. These mechanical stops 17, 19 comprise an interconnection of a series of male steps which engage in corresponding female steps of the complementary part as described in more detail herein.

Figure 3:
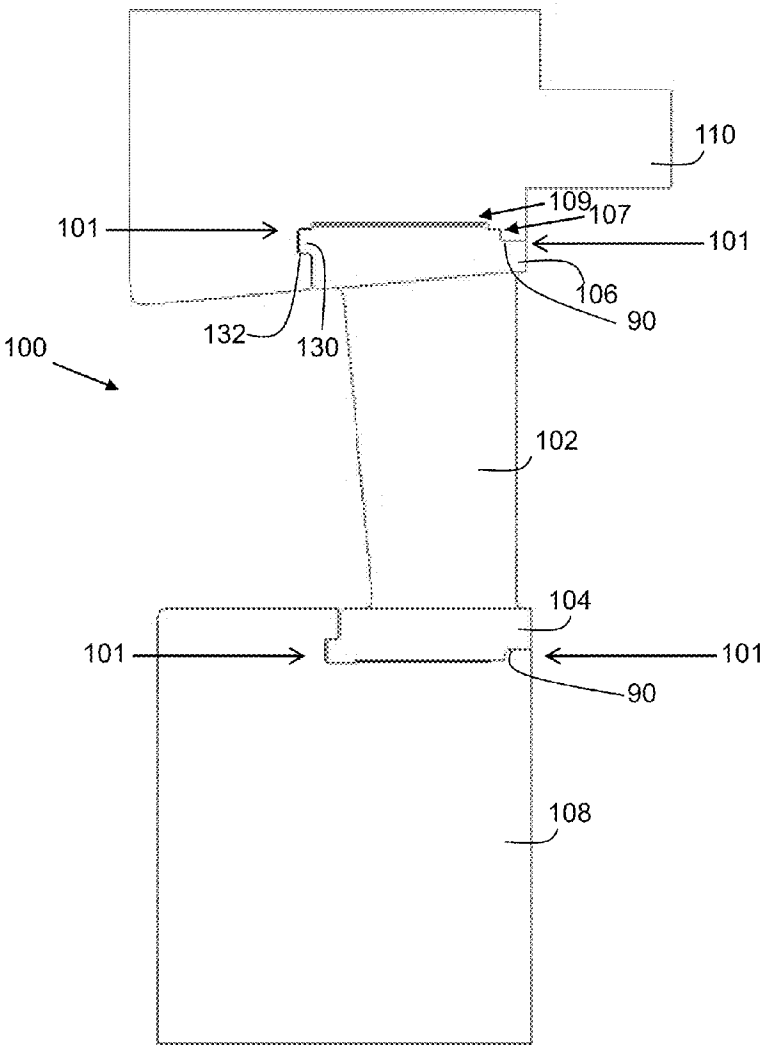
FIG. 3 shows a schematic of a nozzle assembly for a turbine according to embodiments of this invention.

Turning to FIG. 3, a nozzle assembly 100 for a turbine according to embodiments of this invention is shown. As shown in FIG. 3, nozzle assembly 100 includes at least one airfoil 102 having an inner sidewall 104 and an outer sidewall 106. Nozzle assembly 100 further includes an inner ring 108 and an outer ring 110. As will be discussed in more detail herein, inner ring 108 and inner sidewall 104 (and similarly outer ring 110 and outer sidewall 106) are coupled together at an interface 101 by a combination of mechanical elements and a weld. Interfaces 101 are understood to refer to the entire areas where the rings and sidewall are adjacent and coupled. The portions of interfaces 101 that are welded together are shown generally as areas 90 in FIG. 3.

As shown in FIG. 3 (and discussed in more detail in connection with FIG. 5), interfaces 101 between rings 108, 110 and sidewalls 104, 106 may each include a mechanical radial stop 109 which maintains airfoil 102 in the correct radial position during welding and prevents weld shrinkage. Interfaces 101 each may further include a mechanical axial stop 107 which maintains airfoil 102 in the correct axial position and controls the weld length depth. These mechanical stops 107, 109 comprise an interconnection of a series of male steps which engage in corresponding female steps of the complementary part, as disclosed herein.

Figure 4:
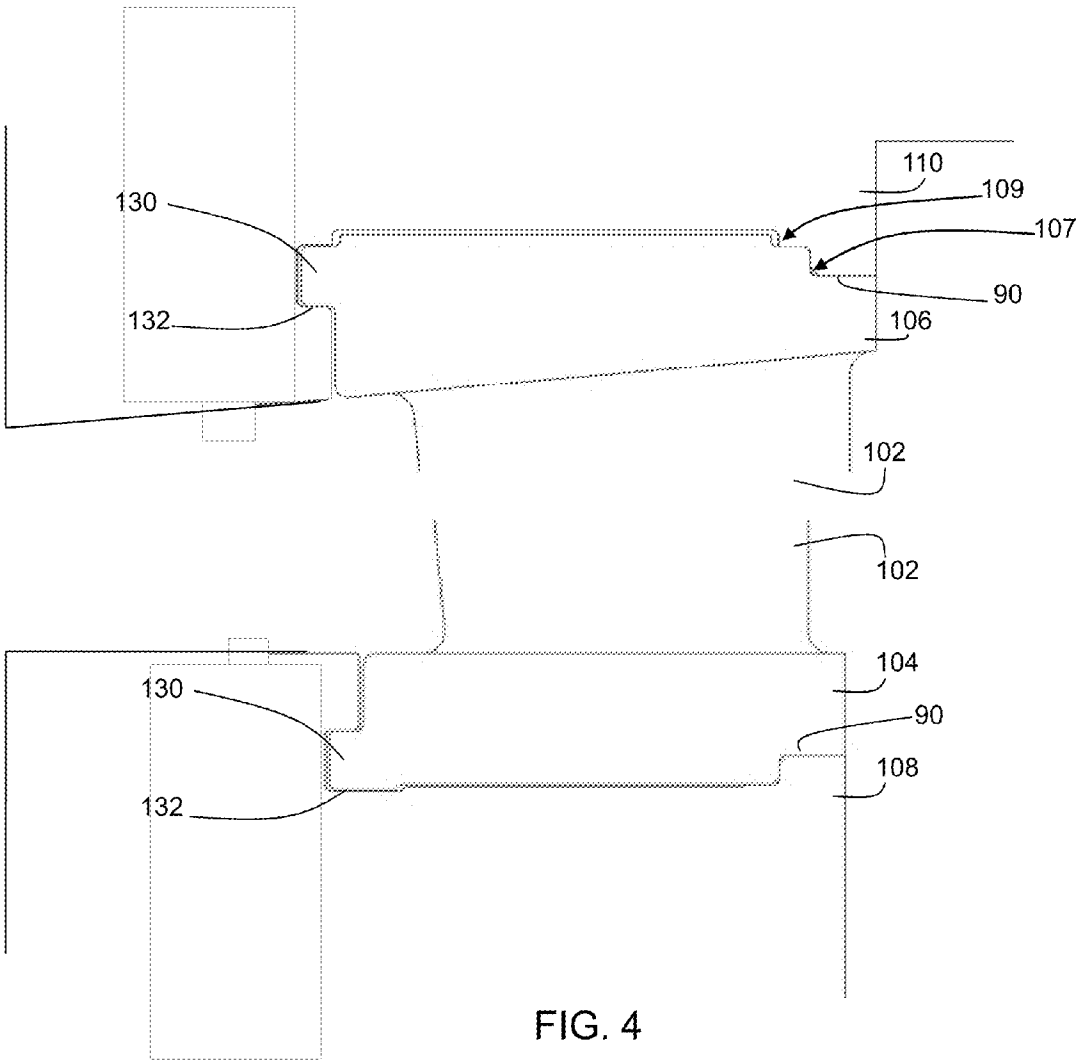
FIGS. 4-15 show exploded cross-sectional views of the interface between a sidewall and a ring of a nozzle assembly according to embodiments of this invention.

As shown in FIG. 3, and in the exploded cross-section of FIG. 4 illustrating interfaces 101 (between inner ring 108 and inner sidewall 104, and between outer ring 110 and outer sidewall 106), an embodiment of this invention includes outer sidewall 106 and/or inner sidewall 104 further including protruding hooks 130 that extend into corresponding hook recesses 132 in outer ring 110 and/or inner ring 108. For example, as shown in FIG. 4, the front (entrance) sides of interface 101 between outer sidewall 106 and outer ring 110 (and between inner sidewall 104 and inner ring 108) are coupled through mechanical hook 130 and the back (exit) sides are coupled through a weld (welded portion is indicated generally by area 90). Using hooks 130 and hook recesses 132 on one side of interface 101 eliminates the need to weld that side of interface 101.

It is also noted that for expediency sake, this disclosure discusses embodiments of this invention with respect to outer sidewall 106 and outer ring 110, but similar embodiments are also disclosed for inner sidewall 104 and inner ring 108. With respect to inner sidewall 104 and inner ring 108, the configuration of male steps which engage in the corresponding female steps of the complementary part can be identical to those used for outer sidewall 106 and outer ring 110, can be a mirror image of that configuration, or can be any other known configuration. Similarly, the configuration of the hook and hook recess can be identical to those used for outer sidewall 106 and outer ring 110, can be a mirror image of that configuration or can be any other known configuration.

Figure 5:
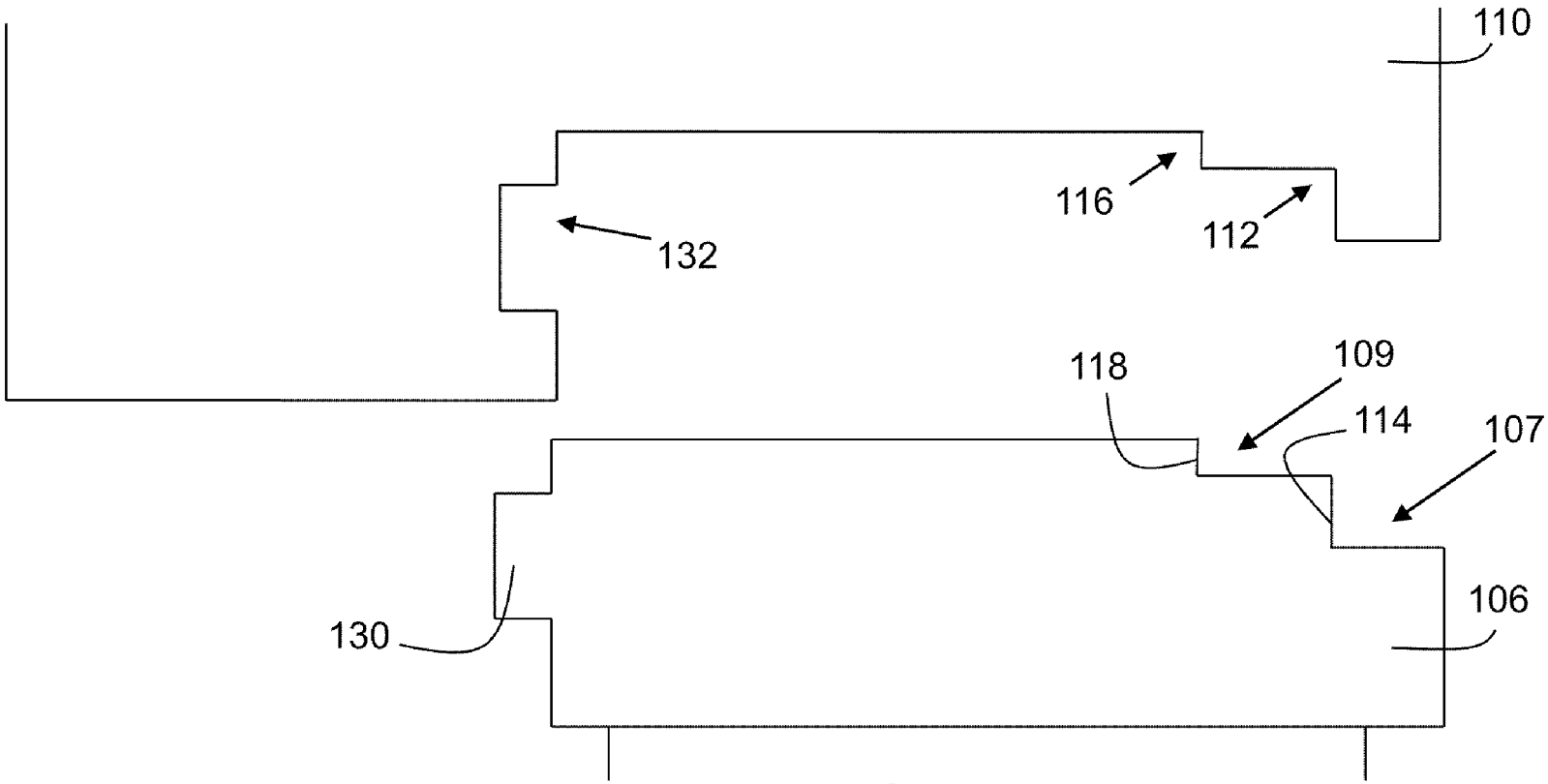

Turning to FIG. 5, a line drawing of outer ring 110 and outer sidewall 106, exaggerated for purposes of explanation, is shown, with outer ring 110 and outer sidewall 106 not yet connected. As shown, radial stop 109 and axial stop 107 are formed by an interconnection of a series of male steps which engage in corresponding female steps of the complementary part once mated together. For example, mechanical axial stop 107 can be formed by outer ring 110 including a first female step 112 and outer sidewall 106 including a corresponding first male step 114. Mechanical radial stop 109 can be formed by outer ring 110 having a second female step 116, adjacent to first female step 112, and outer sidewall 106 including a corresponding second male step 118, adjacent to first male step 114. It is also noted that while the female and male steps are shown in the two-dimensional cross-sections as substantially horizontal, these parts may also be angled to assist proper placement of the parts of the nozzle assembly.

Exploded cross-sectional views of interface 101 between an outer sidewall and an outer ring of a nozzle assembly according to various embodiments of this invention are shown in FIGS. 5-12. For example, various configurations are possible with respect to the location of the hooks 130, hook recesses 132, and male and female steps forming axial stops 107 and radial stops 109. For example, hooks 130 can be provided on different sides of interface 101, e.g., a front (entrance) side or a back (exit) side of airfoil 102. Also, hooks 130 can protrude from either a sidewall 104, 106 or a ring 108, 110. In addition, the configuration of male and female steps can be reversed so that either sidewall 104, 106 or ring 108, 110 can include male or female steps.

Figure 6:
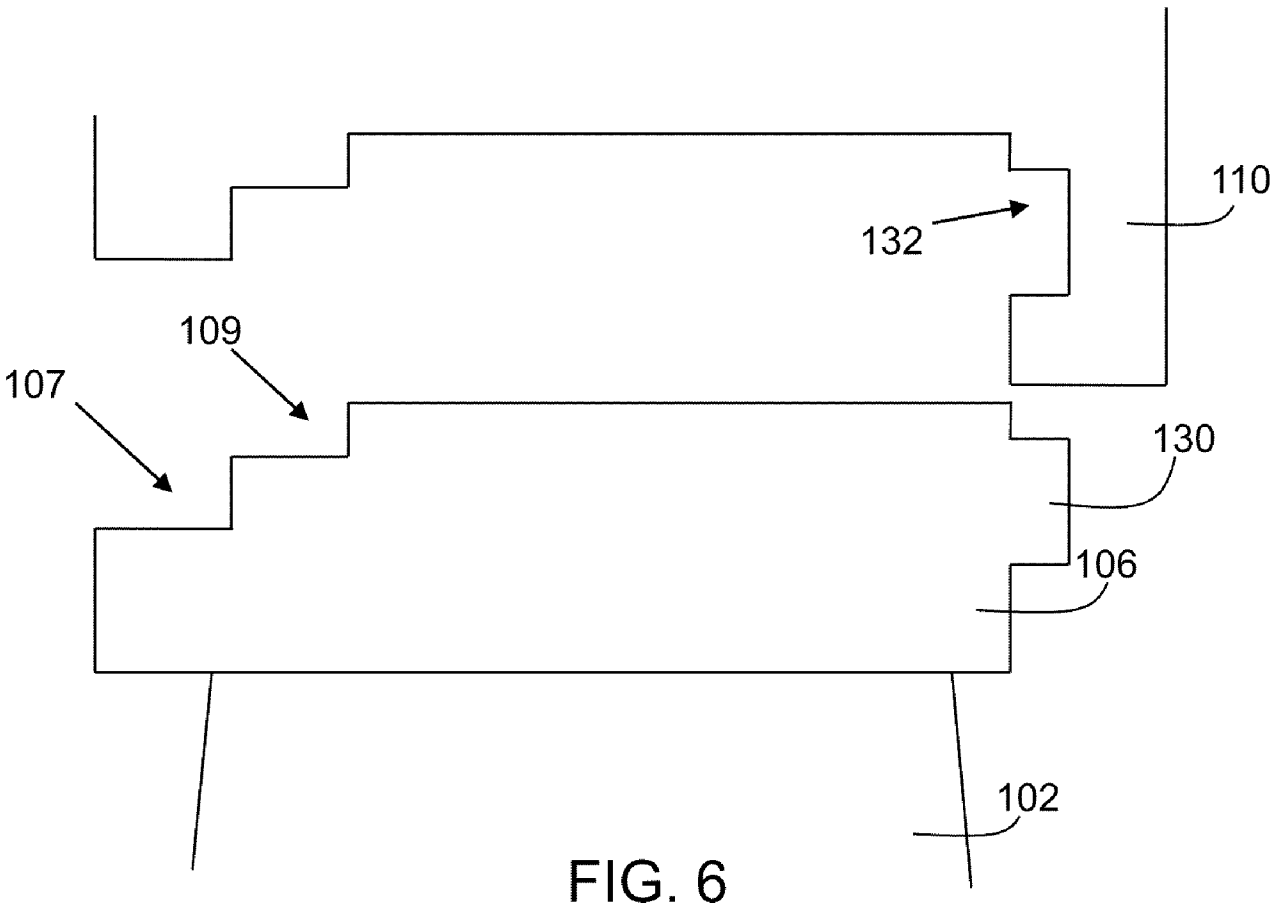

As shown in FIG. 5, in one embodiment, outer sidewall 106 can include hook 130 while outer ring 110 includes hook recess 132, and hook 130 can be provided on the front (entrance) side of outer sidewall 106. In addition, outer sidewall 106 may include male steps, while outer ring 110 can include female steps to form radial stop 109 and axial stop 107. As shown in FIG. 6, a configuration similar to FIG. 5 can be provided, except that hook 130 can be provided, instead, on the back (exit) side of outer sidewall 106.

Figure 7:
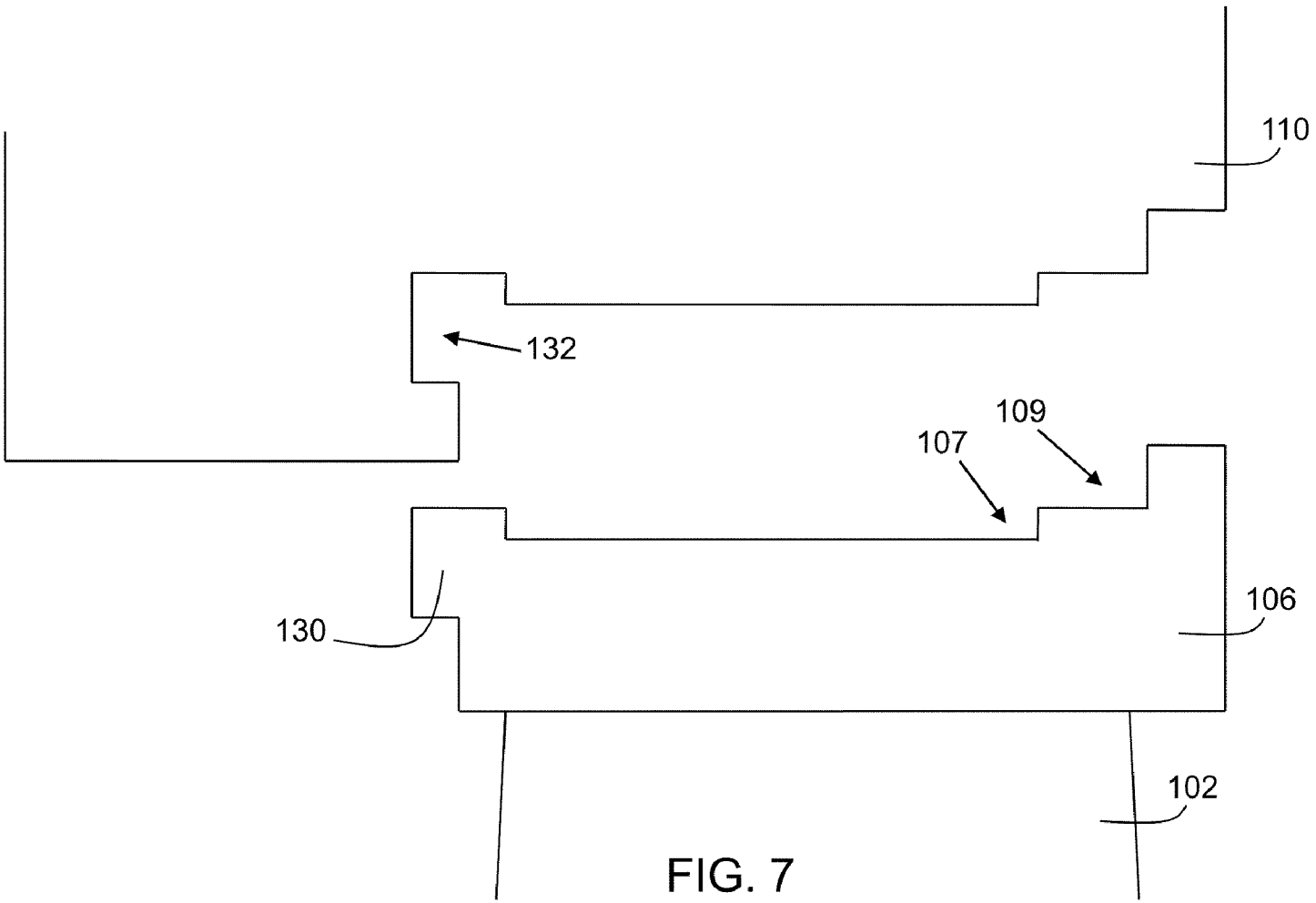
Figure 8:
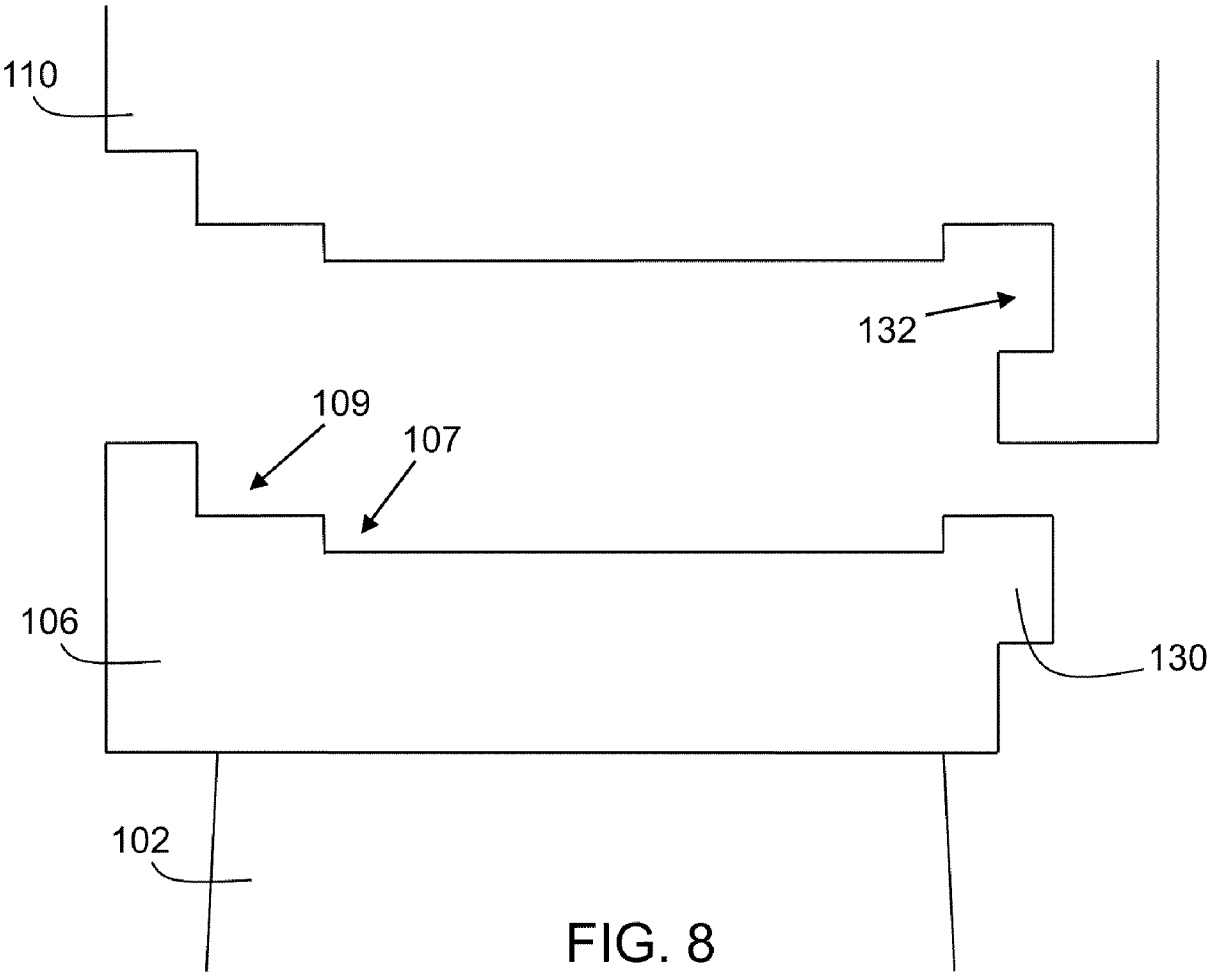

As shown in FIG. 7, in another embodiment, outer sidewall 106 can include hook 130 while outer ring 110 includes hook recess 132, and hook 130 can be provided on the front (entrance) side of outer sidewall 106. However, in contrast to the embodiment shown in FIG. 5, in this embodiment, outer sidewall 106 may include female steps, while outer ring 110 can include male steps to form radial stop 109 and axial stop 107. As shown in FIG. 8, a configuration similar to FIG. 7 can be provided, except that hook 130 can be provided, instead, on the back (exit) side of outer sidewall 106.

Figure 9:
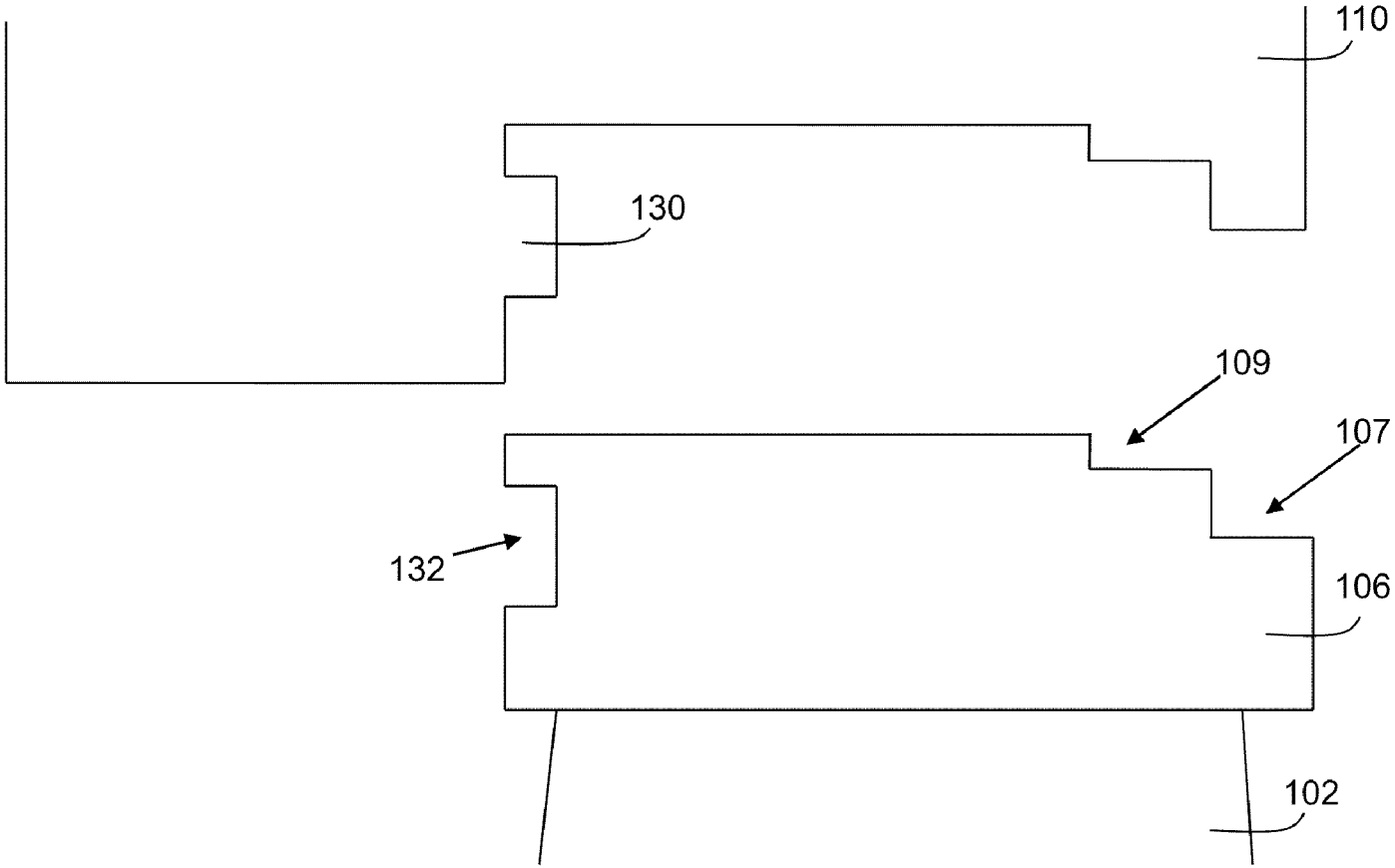
Figure 10:
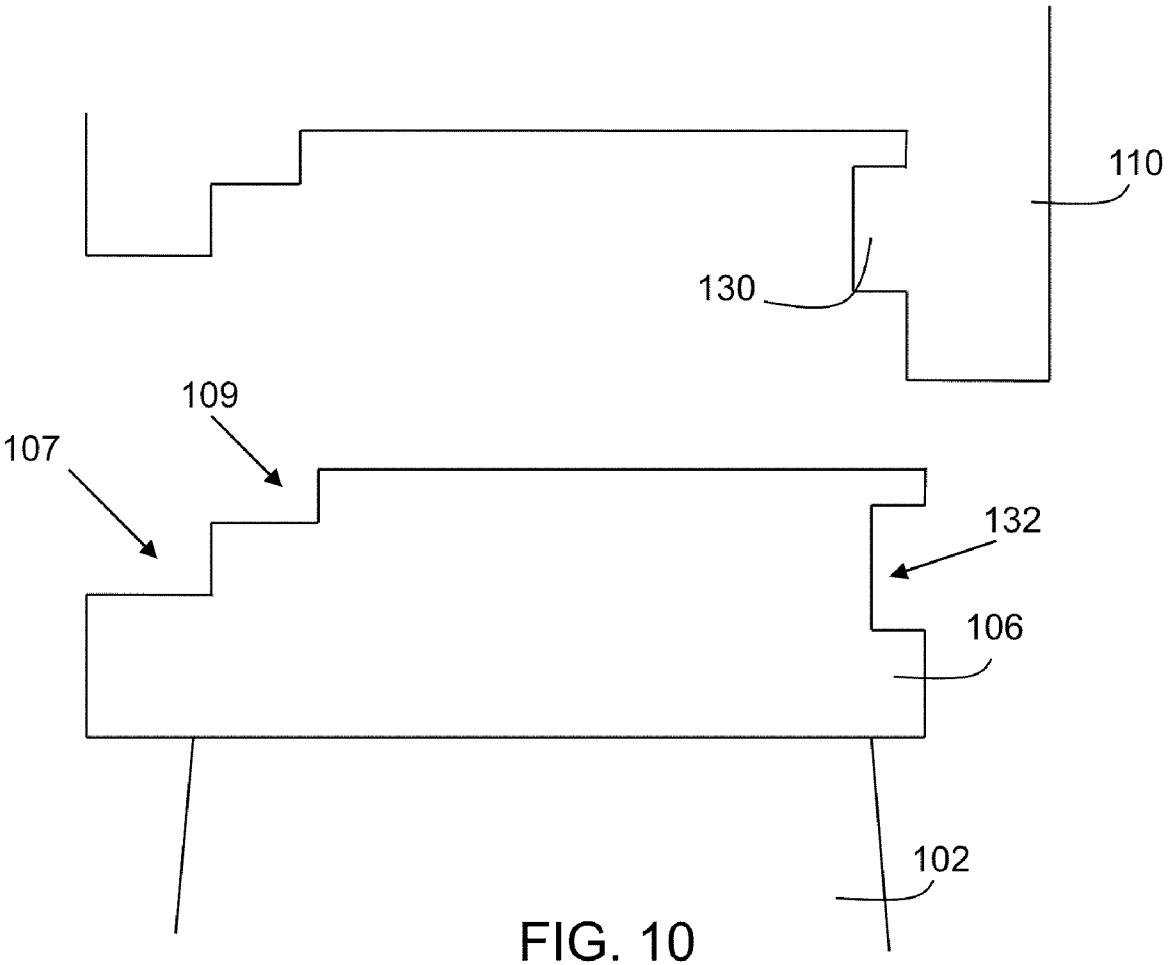

As shown in FIG. 9, in another embodiment, outer ring 110 can include hook 130 while outer sidewall 106 includes hook recess 132, and hook 130 can be provided on the front (entrance) side of outer ring 110. In addition, outer sidewall 106 may include male steps, while outer ring 110 can include female steps to form radial stop 109 and axial stop 107. As shown in FIG. 10, a configuration similar to FIG. 9 can be provided, except that hook 130 can be provided, instead, on the back (exit) side of outer ring 110.

Figure 11:
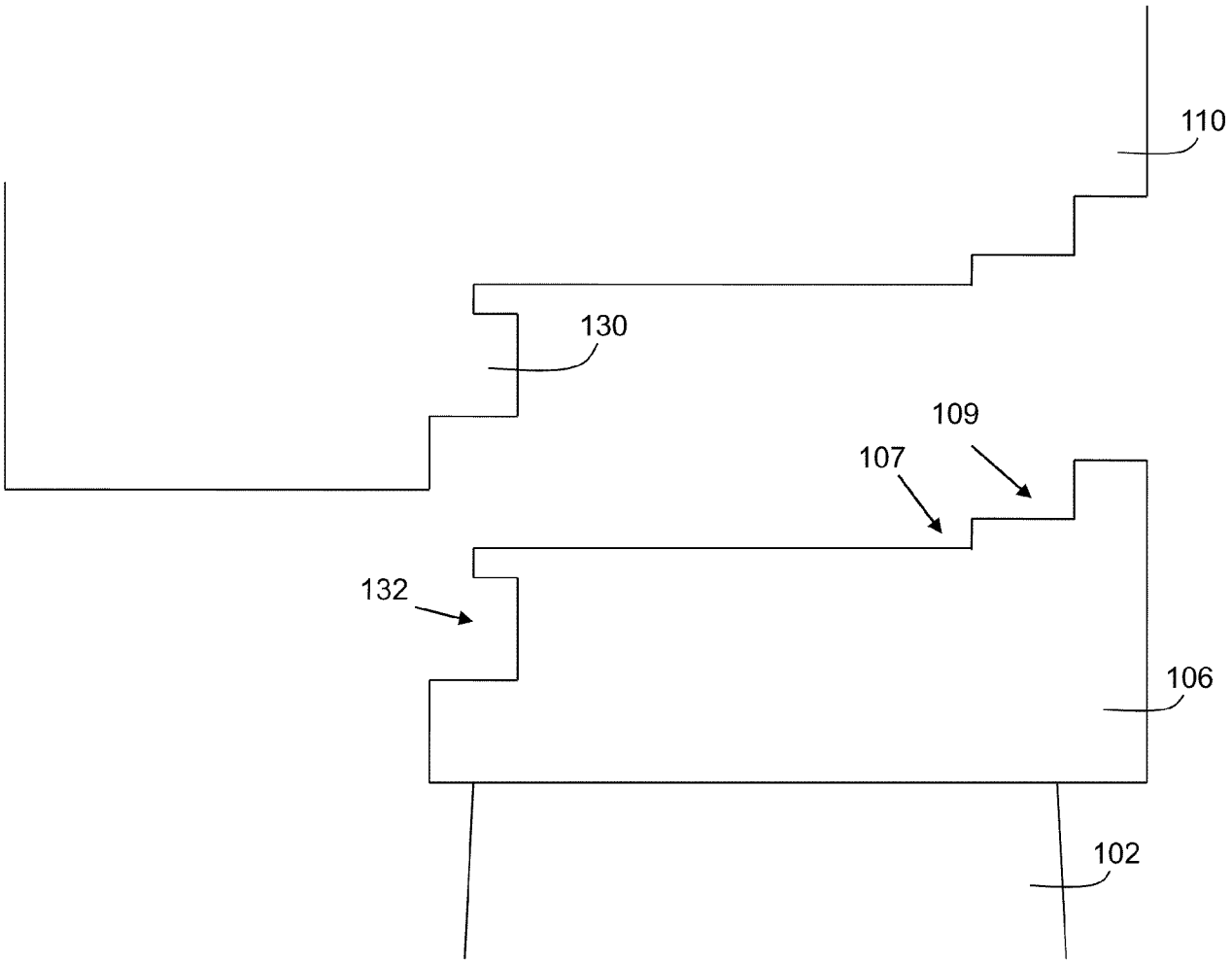
Figure 12:
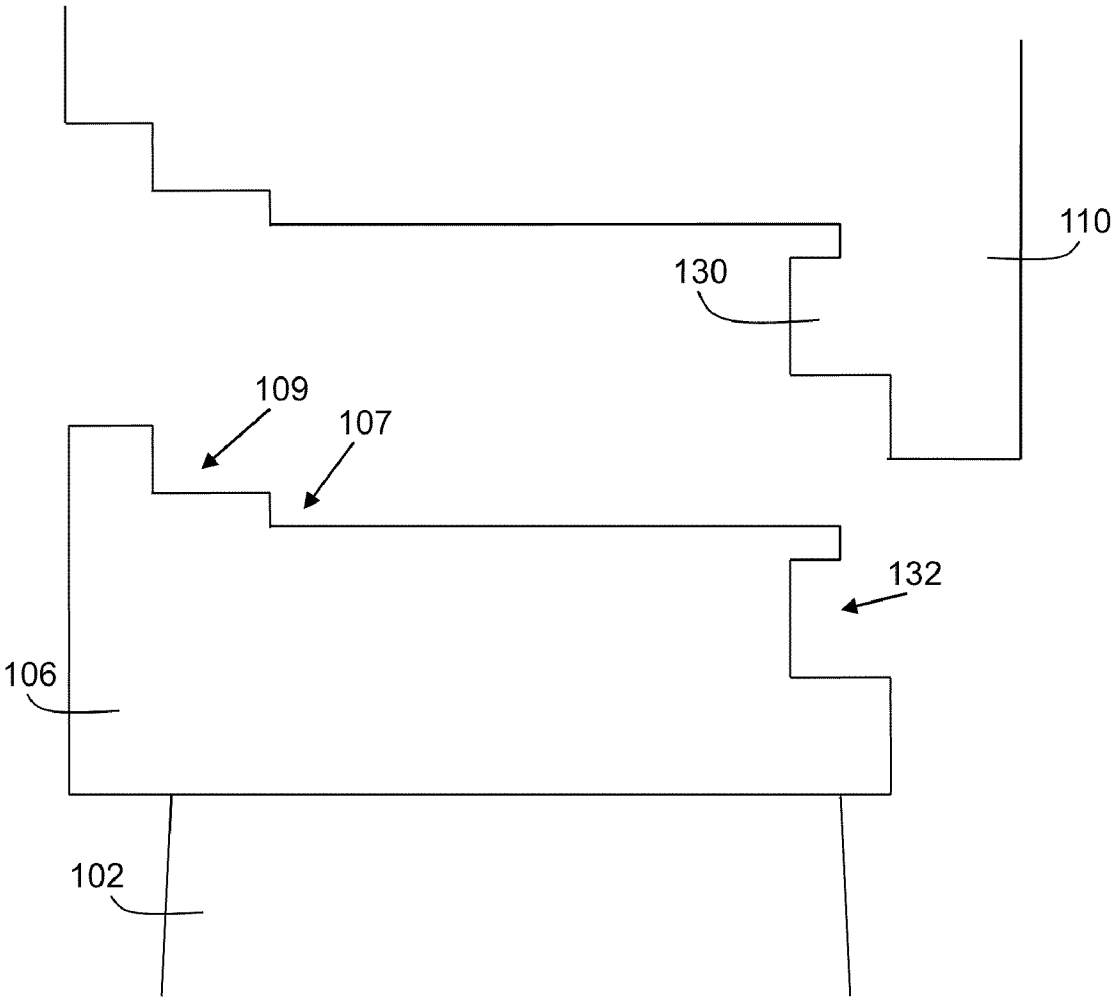

As shown in FIG. 11, in another embodiment, outer ring 110 can include hook 130 while outer sidewall 106 includes hook recess 132, and hook 130 can be provided on the front (entrance) side of outer ring 110. However, in contrast to the embodiment shown in FIG. 9, in this embodiment, outer sidewall 106 may include female steps, while outer ring 110 can include male steps to form radial stop 109 and axial stop 107. As shown in FIG. 12, a configuration similar to FIG. 11 can be provided, except that hook 130 can be provided, instead, on the back (exit) side of outer ring 110.

When hook 130 is on the exit side of airfoil 102, hook 130 further aids in axial positioning. When hook 130 is on the entrance side, it further keeps airfoil 102 positioned radially as it is assembled and helps in containing airfoil 102 when pressure is applied while the nozzles are stacked in the assembly prior to welding. Hook 130 also holds nozzle assembly 100 in position when the opposing side is welded because the weld on the opposing side will shrink and will want to lift the opposite side during the weld shrinking process. In addition, hook 130 allows for more determinant stress concentration (Kt) factors, as compared to the sharp discontinuity that is caused when welding at the same interface 101. The moment on nozzle assembly 100 is typically downstream which causes a tensile force on the weld. This force is now transferred via hook 130 with known stress concentrations factors. The downstream weld is typically in compression that allows for less concern with the weld Kt. Nozzle assembly 100 may also include a protective coating to resist the erosion environment, such as a diffusion titanium nitride (TiN) coating or aluminum titanium nitride (AlTiN) coating. In contrast to fully welded prior art configurations, the mechanical and weld configuration of this disclosure allows the coating to be easily put on airfoil 102 prior to the welding operation.

The mechanical hook and welded design of this disclosure further allows for reduced part cost and machining cycles when compared to fully welded designs. This is because, as shown in the figures, the area in front of the airfoil's entrance or front side can be larger in the axial direction than previous designs, so the airfoil does not need to be machined down to the desired size, as is necessary to do in fully welded designs.

Additionally, being welded creates determinant boundary conditions when doing an analysis of the component. In other words, when doing finite element analysis of nozzle assembly 100 or other calculations, the structure is determinant, i.e., there are no sliding surfaces that may change boundary conditions during operation. Nozzles slid into a groove, but not welded, can vibrate or move if not tightly packed or bolted or pinned to the rings.

Figure 13:
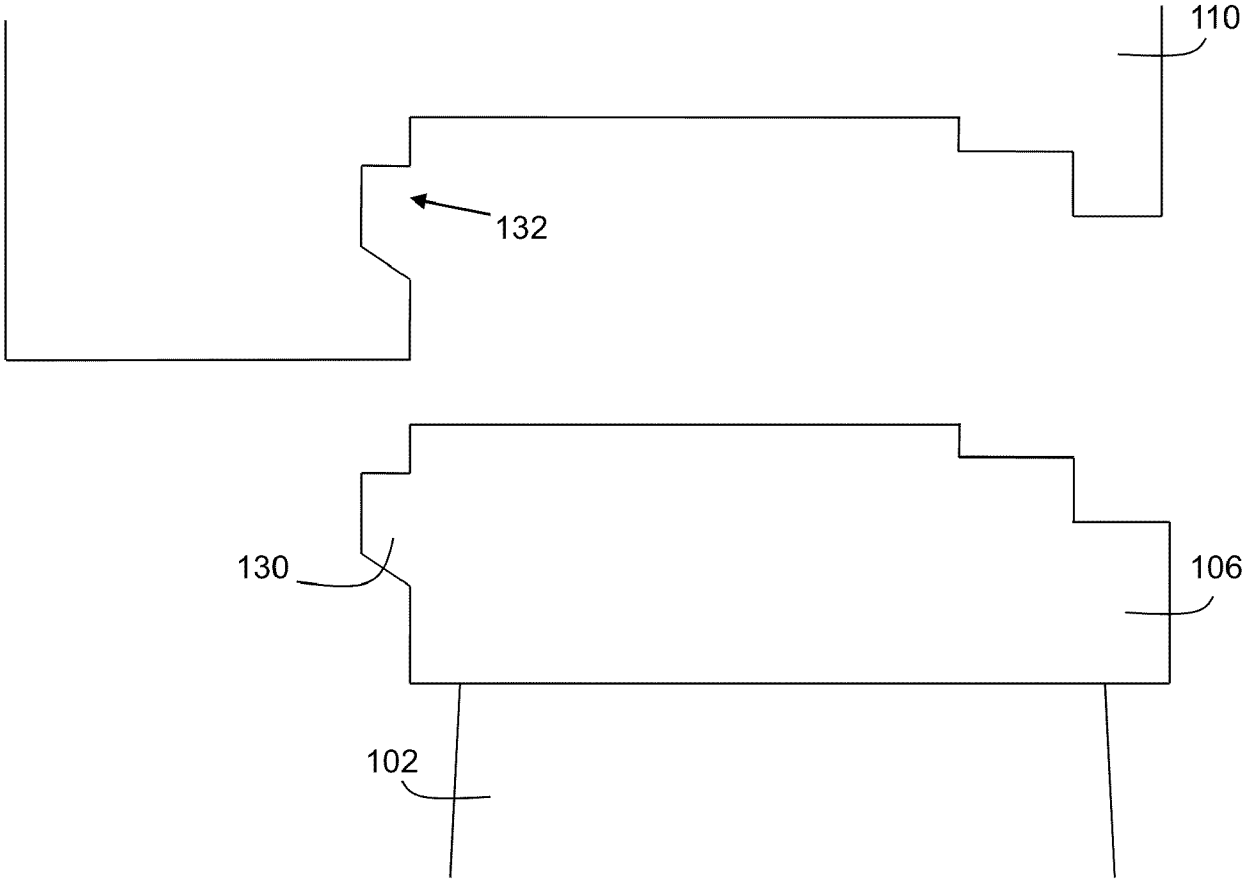

While hook 130 can be orientated substantially perpendicular to the sidewall or ring that it protrudes from, as shown in FIGS. 1-12, one or more sides of hook 130 can also be oriented at an angle to the sidewall or ring that it protrudes from, up to a vertical orientation. An example of hook 130 with an angled side is shown in FIG. 13. A side of hook recess 132 can be similarly angled to allow for coupling with hook 130. While the angled hook 130 is shown in FIG. 13 as included in the front (entrance) side, as explained herein, angled hook 130 can also be provided on the back (exit) side. In addition, although angled hook 130 is shown as protruding from outer sidewall 106, and outer ring is shown as having angled hook recess 132, the reverse, as discussed herein, is also disclosed. In other words, outer sidewall 106 could include angled hook recess 132 while outer ring can have protruding angled hook 130.

The portions of outer ring 110 and outer sidewall 106 that are welded together can be welded using conventional low heat welding techniques, as well as higher heat welds, such as gas tungsten arc weld (GTAW), using an energized or non-energized filler wire, gas metal arc weld (GMAW) or electron beam weld (EBW). If a GTAW (also known as TIG) weld is used, a manual TIG weld or fully-automated TIG weld can be used.

Using the configuration of embodiments of this invention, the stress concentration on the root of a weld between outer sidewall 106 and outer ring 110 is in a substantially vertical direction. In addition, the ratio of weld depth to width of the weld is preferably in the range of approximately 3:1 to 10:1.

Figure 14:
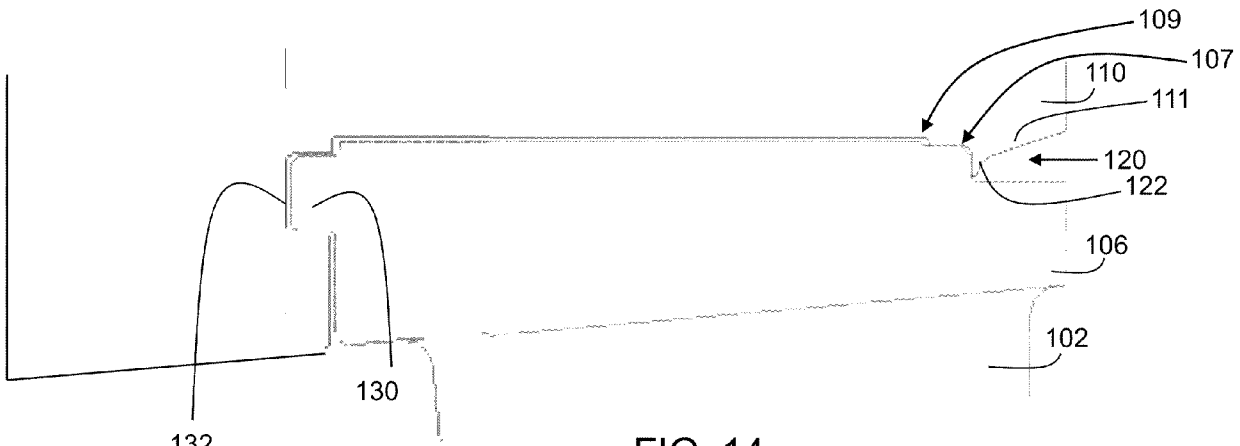
Figure 15:
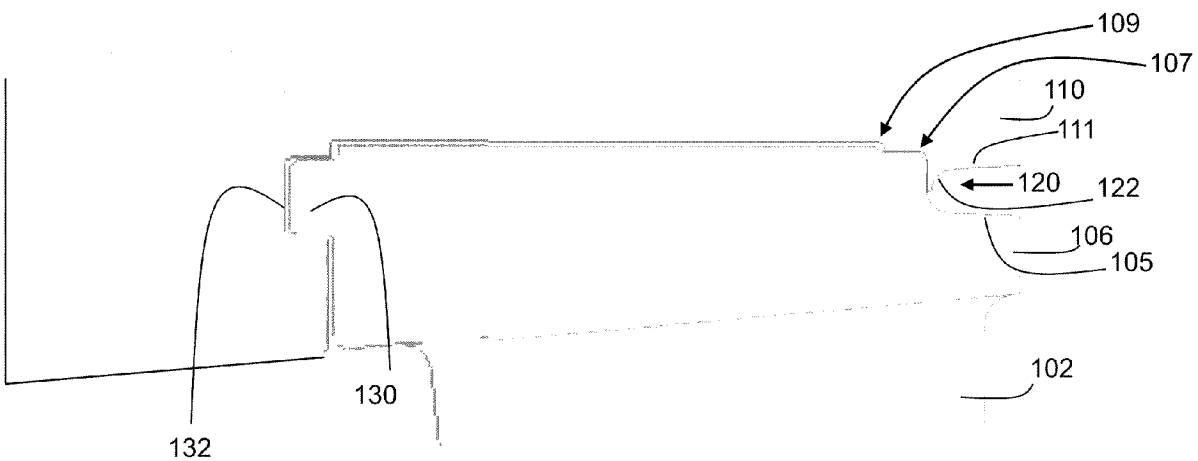

Turning to FIGS. 14 and 15, in another embodiment of this invention, outer ring 110 can further include a protruding consumable root portion 122 that extends toward interface 101 between outer sidewall 106 and outer ring 110. Consumable root portion 122 can include a material having any shape and size suitable for facilitating a weld at interface 101 between outer ring 110 and outer sidewall 106. For example, consumable root portion 122 can include a chamfer, or a square bottom groove. Consumable root portion 122 can act as a consumable root for a weld, such as a TIG weld or can act as a fixturing stop for a weld, such as an electron beam weld (EBW), to ensure that the parts remain in the correct position.

In addition, a portion of either outer ring 110 or outer sidewall 106 can be angled away from interface 101 to form a narrow groove 120. As shown in FIG. 14, an embodiment of this invention further includes a portion of outer ring 110, shown as portion 111, angled away from interface 101 to form narrow groove 120. Narrow groove 120 can be formed by angling portion 111 of outer ring 110 to an angle in the range of approximately 0° to approximately 11°. As shown in FIG. 15, a portion of both outer ring 110 (shown as portion 11) and outer sidewall 106 (shown as portion 105), that abuts outer ring 110 can be angled away from interface 101. In contrast to FIG. 14, where only one surface at ring/sidewall interface 101 was angled away from interface 101, the embodiment shown in FIG. 15 includes both surfaces 105, 111 angled away from interface 101 to form narrow groove 120. Again, portion 105 can be angled away from interface 101 at an angle in the range of approximately 0° to approximately 11°.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A nozzle assembly for a turbine, the nozzle assembly comprising:

an airfoil having an outer sidewall;

an outer ring mechanically coupled to the outer sidewall at an interface;

a mechanical axial stop at the interface of the outer sidewall and the outer ring, the mechanical axial stop configured to maintain the airfoil in a correct axial position; and a mechanical radial stop at the interface of the outer sidewall and the outer ring, the mechanical radial stop configured to maintain the airfoil in a correct radial position, one of the outer sidewall and the outer ring including a protruding hook that extends into a corresponding hook recess in the other of the outer ring and the outer sidewall, wherein a first side of the interface is mechanically coupled together via the protruding hook and the corresponding hook recess, and a second side of the interface includes a welded connection.

2. The nozzle assembly of claim 1, wherein the mechanical axial stop includes one of:

(a) the outer ring having a first female step and the outer sidewall having a corresponding first male step, and (b) the outer sidewall having a first female step and the outer ring having a corresponding first male step, wherein the mechanical axial stop enables interlocking engagement between the outer ring and the outer sidewall.

3. The nozzle assembly of claim 2, wherein the mechanical radial stop includes one of:

(a) the outer ring having a second female step, adjacent to the first female step, and the outer sidewall having a corresponding second male step, adjacent to the first male step, and (b) the outer sidewall having a second female step, adjacent to the first female step and the outer ring having a corresponding second male step, adjacent to the first male step, wherein the mechanical radial stop also enables interlocking engagement between the outer ring and the outer sidewall.

4. The nozzle assembly of claim 1, wherein the protruding hook and the corresponding hook recess are substantially perpendicular to the outer sidewall and the outer ring.

5. The nozzle assembly of claim 1, wherein a side of the protruding hook and a side of the corresponding hook recess are angled away from the interface at an angle in the range of approximately 0° to approximately 90°.

6. The nozzle assembly of claim 1, wherein the outer ring at the second side of the interface further includes a protruding consumable root portion that extends toward the second side of the interface of the outer sidewall and the outer ring.

7. The nozzle assembly of claim 1, wherein one of (a) a portion of the outer ring at the second side of the interface, and (b) a portion of the outer sidewall at the second side of the interface is angled away from the second side of the interface at an angle in the range of approximately 0° to approximately 11°.

8. The nozzle assembly of claim 1, wherein both a portion of the outer ring at the second side of the interface and a portion of the outer sidewall at the second side of the interface are angled away from the second side of the interface at an angle in the range of approximately 0° to approximately 11°.

9. The nozzle assembly of claim 1, wherein the airfoil includes a protective coating thereon to resist an erosion environment.

10. The nozzle assembly of claim 1, wherein the welded connection at the second side of the interface includes one of the following welding techniques: gas tungsten arc welding (GTAW) using an energized filler wire, GTAW using a non-energized filler wire, gas metal arc welding (GMAW) or electron beam welding (EBW).

11. The nozzle assembly of claim 10, wherein a stress concentration on the weld at the welded connection is in a substantially vertical direction.

12. The nozzle assembly of claim 10, wherein a ratio of weld depth to a width of the weld is in the range of approximately 3:1 to 10:1.

13. A nozzle assembly for a turbine, the nozzle assembly comprising:

an airfoil having an inner sidewall;

an inner ring mechanically coupled to the inner sidewall at an interface;

a mechanical axial stop at the interface of the inner sidewall and the inner ring, the mechanical axial stop configured to maintain the airfoil in a correct axial position; and a mechanical radial stop at the interface of the inner sidewall and the inner ring, the mechanical radial stop configured to maintain the airfoil in a correct radial position, one of the inner sidewall or the inner ring including a protruding hook that extends into a corresponding hook recess in the other of the inner ring or the inner sidewall;

wherein a first side of the interface is mechanically coupled together via the protruding hook and the corresponding hook recess, and a second side of the interface includes a welded connection.

14. The nozzle assembly of claim 13, wherein the mechanical axial stop includes one of:

(a) the inner ring having a first female step and the inner sidewall having a corresponding first male step, and (b) the inner sidewall having a first female step and the inner ring having a corresponding first male step, wherein the mechanical axial stop enables interlocking engagement between the inner ring and the inner sidewall.

15. The nozzle assembly of claim 14, wherein the mechanical radial stop includes one of:

(a) the inner ring having a second female step, adjacent to the first female step, and the inner sidewall having a corresponding second male step, adjacent to the first male step, and (b) the inner sidewall having a second female step, adjacent to the first female step and the inner ring having a corresponding second male step, adjacent to the first male step, wherein the mechanical radial stop also enables interlocking engagement between the inner ring and the inner sidewall.

16. The nozzle assembly of claim 13, wherein the protruding hook and the corresponding hook recess are substantially perpendicular to the inner sidewall and the inner ring.

17. The nozzle assembly of claim 13, wherein a side of the protruding hook and a side of the corresponding hook recess are angled away from the interface at an angle in the range of approximately 0° to approximately 90°.

18. The nozzle assembly of claim 13 wherein the inner ring at the second side of the interface further includes a protruding consumable root portion that extends toward the second side of the interface of the inner sidewall and the inner ring.

19. The nozzle assembly of claim 13, wherein one of (a) a portion of the inner ring at the second side of the interface, or (b) a portion of the inner sidewall at the second side of the interface is angled away from the second side of the interface at an angle in the range of approximately 0° to approximately 11°.

20. The nozzle assembly of claim 13, wherein both a portion of the inner ring at the second side of the interface and a portion of the inner sidewall at the second side of the interface are angled away from the second side of the interface at an angle in the range of approximately 0° to approximately 11°.

* * * * *